US006000423A

United States Patent [19]

Roloson et al.

[11] Patent Number: 6,000,423

[45] Date of Patent: Dec. 14, 1999

[54] GAS PRESSURE MAINTENANCE BOOSTER SYSTEM

[75] Inventors: Bruce D. Roloson, Apalachin; Ewan Choroszylow, East Aurora; Giovanni Aquino, Kenmore; Paul M. Crvelin, Niagara Falls; Robert W. Stiles, Apalachin, all of N.Y.

[73] Assignee: New York State Electric and Gas Corporation (NYSEG), Binghamton, N.Y.

[21] Appl. No.: 09/078,124

[22] Filed: May 13, 1998

[51] Int. Cl.[6] ..... F17D 1/07

[52] U.S. Cl. ..... 137/334; 137/565.01; 137/565.17; 137/544

[58] Field of Search ..... 137/334, 565.01, 137/565.17, 571, 544; 138/39

[56] References Cited

U.S. PATENT DOCUMENTS

| | | | |
|---|---|---|---|
| 1,858,682 | 5/1932 | Olsson | 137/565.01 |
| 2,870,716 | 1/1959 | Meneley | 137/565.01 |
| 3,288,197 | 11/1966 | Rose | 137/565.01 |
| 3,302,688 | 2/1967 | Thrush | 137/565.01 |

*Primary Examiner*—John Rivell
*Attorney, Agent, or Firm*—Howard J. Greenwald

[57] ABSTRACT

A system for maintaining gas pressure within a gas delivery system. This system contains a first gas flow straightener, a contaminant separation tank, an inlet manifold, a rotary positive displacement compressor, a second gas flow straightener, a radiator, an oil separator/gas receiver tank, and a third gas flow straightener.

19 Claims, 2 Drawing Sheets

GAS PRESSURE MAINTENANCE BOOSTER SYSTEM

FIELD OF THE INVENTION

A system for maintaining or increasing the pressure in a gas delivery system, such as a gas pipeline.

BACKGROUND OF THE INVENTION

Natural gas is a major source of fuel in many parts of the country. It is used for heating and cooling and, additionally, is often used in industrial processes.

In many applications in which natural gas is used, it must be delivered within a specified ranges of pressures. Thus, for example, natural gas engines often require a gas pressure as high as about, e.g., 40 pounds per square inch.

As demand for natural gas has increased, older gas lines have been called upon to deliver more and more gas. In some case, these older gas lines do not deliver gas pressures as high as, e.g., 40 pounds per square inch.

It is advantageous to be able to, at selected points in any gas delivery system, maintain and/or increase the gas pressure so that it will exceed a certain specified minimum value. Thus, one may insert boost compressors at various points in the gas delivery system.

Most compressors, however, are relatively noisy. Thus, their use as boost compressors in or near residential or noise sensitive areas presents a noise abatement problem. Thus, for example, both the United States and New York State proscribe the use of machines which generate more than a certain amount of noise is certain locations. Furthermore, many cities and counties have similar regulations.

It is an object of this invention to provide a system for maintaining and/or boosting gas pressure which, in operation, is relatively quiet.

It is another object of this invention to provide a system for maintaining and/or boosting gas pressure which is reliable and relatively maintenance free.

It is another object of this invention to provide a system for maintaining and/or boosting gas pressure which is relatively vibration-free.

It is another object of this invention to provide a system for maintaining and/or boosting gas pressure which delivers a substantially uniform output flow of gas.

It is another object of this invention to provide a system for maintaining and/or boosting gas pressure which is relatively small, lightweight, and inexpensive.

SUMMARY OF THE INVENTION

In accordance with this invention, there is provided a system for maintaining gas pressure. This system contains a first gas flow straightener, a contaminant separation tank, an inlet manifold, a rotary positive displacement compressor, a second gas flow straightener, a radiator, an oil separator/gas receiver tank, and a third gas flow straightener.

BRIEF DESCRIPTION OF THE DRAWINGS

The claimed invention will be described by reference to the following drawings, in which like reference numerals refer to like elements, and in which:

DESCRIPTION OF THE PREFERRED EMBODIMENTS

Figure 1:
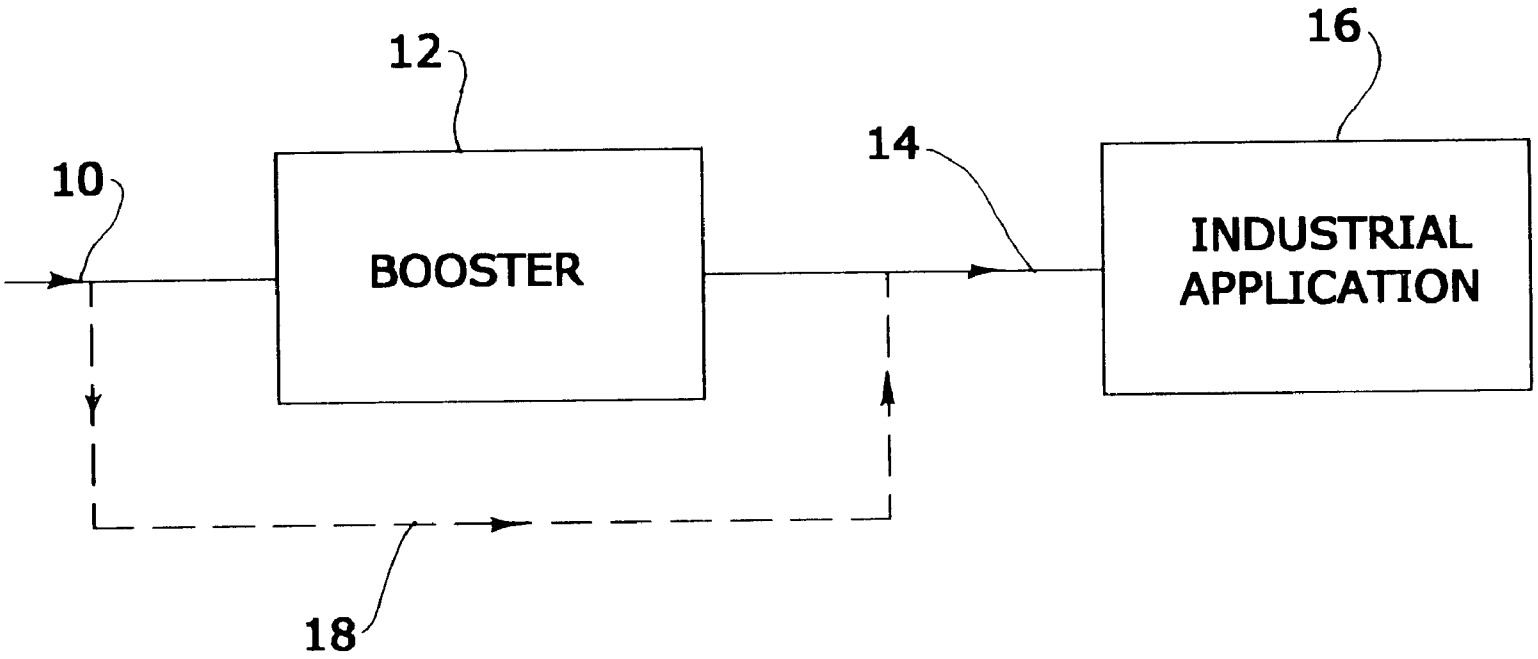
FIG. 1 is a diagram of the gas line pressure maintenance booster system of this invention in operation in an industrial process.

FIG. 1 is a diagram of one preferred process of the invention. Referring to FIG. 1, it will be seen that gas (not shown) is preferably passed via gas line 10 to gas line pressure maintenance booster system 12 and thereafter, via line 14 to industrial customer application 16. Alternatively, in a prior practice, the gas was fed via gas lines 10, 18, and 14 to industrial customer application 16.

As is apparent to those skilled in the art, the gas delivered via lines 10, 18, and 14 frequently was at a pressure different than that required by customer application 16. As will be described in detail in the remainder of this specification, the insertion of one or more booster systems 12 allows one to remedy this problem.

Figure 2:
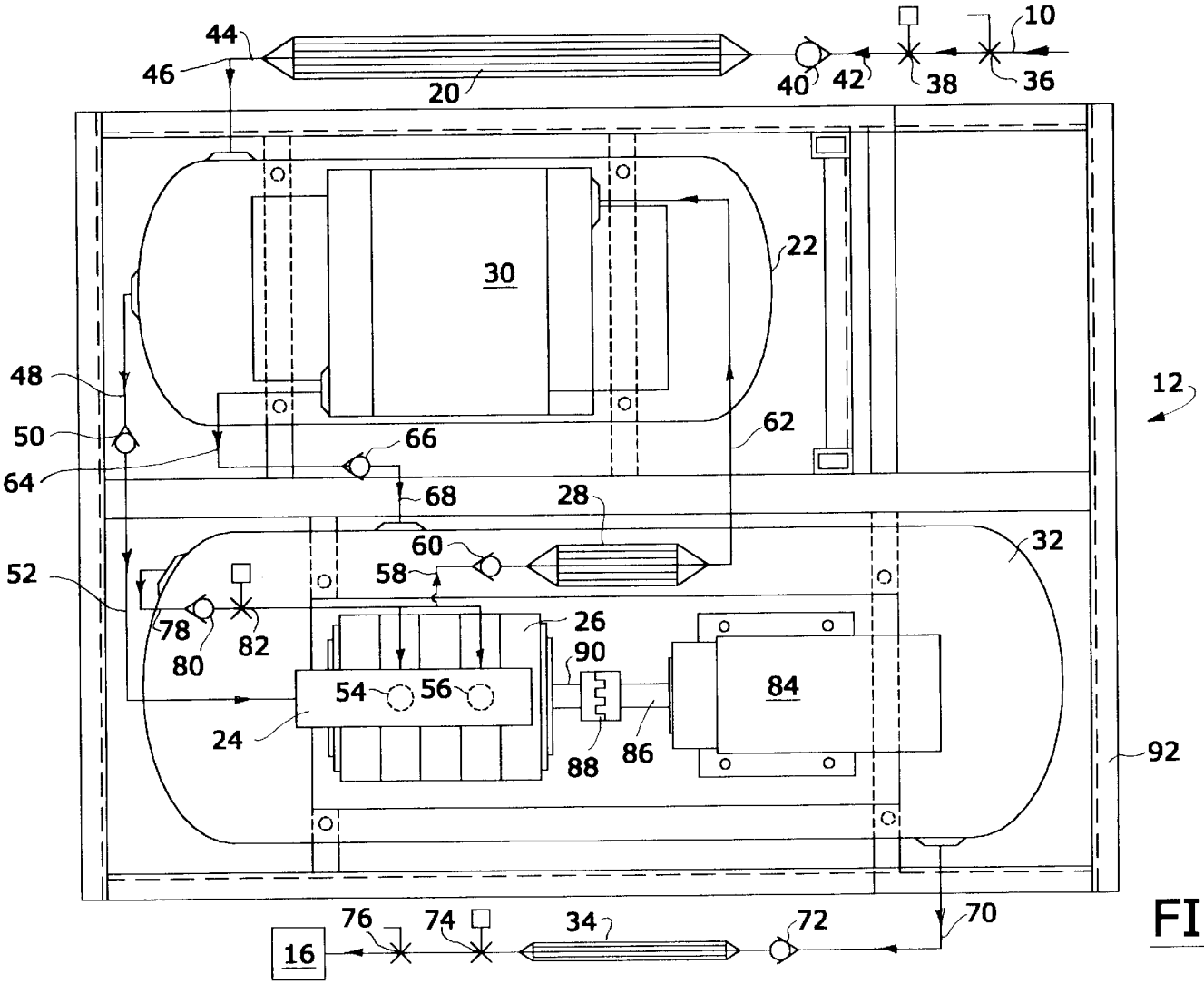
FIG. 2 is a top view of one preferred gas line pressure maintenance booster system of this invention.

FIG. 2 is a top view of one preferred gas line pressure maintenance booster system (hereinafter referred to as "booster system") 12. Referring to FIG. 2, and in the preferred embodiment depicted therein, it will be seen that booster system 12 is comprised of an inlet flow straigthener 20, a gas contaminant separator tank 22, an inlet manifold 24, a rotary positive displacement compressor 26, a compressor discharge flow straightener 28, a radiator 30, an oil separator/gas receiver tank 32, and a system discharge flow straightener 34.

Referring to FIG. 2, it will be seen that gas (not shown) is passed via line 10 past manual shut off valve 36. In one preferred embodiment, manual shut off valve 36 is a manual ball valve.

The gas passing past manual ball valve 36 is then passed pass solenoid valve 38. As will be understood by those skilled in the art, the solenoid valve is the primary means used to control the gas flow, and it is connected to a controller (not shown). In cases where the electrical power to the system fails for some reason, one may then use manual shut off valve.

Referring again to FIG. 2, the gas passing past solenoid valve 38 is then fed through inlet check valve 40, which allows flow only in the direction of arrow 42. These directional valves are well known in the art. See, e.g. U.S. Pat. Nos. 5,620,309, 5,611,671, 5,611,664, 5,609,476, 5,605,435, and the like. The entire disclosure of each of these United States patents is hereby incorporated by reference into this specification.

The gas passing through the inlet check valve 40 is then fed to inlet flow straightener 20. As will apparent to those skilled in the art, the function of straightener 20 is reduce the turbulence in the inlet flow stream. One may use any of the conventional flow straighteners described in the prior art. Thus, e.g., one may use one or more of the flow straighteners described in U.S. Pat. Nos. 5,596,152 (flow straightener for eliminating vortices in a gas stream), 5,509,609 (means for minimizing turbulence within a nozzle, 5,501,101, 5,283,990 (inlet flow straightener), 4,802,342, 4,080,997, and the like. The entire disclosure of each of these United States patents is hereby incorporated by reference into this specification.

In is preferred that the flow straightener 20 reduce the Reynolds number of the gas flowing through it so that the gas flowing through 44 has substantially laminar flow. Gas with substantially laminar flow, and means for obtaining such flow, are well known to those skilled in the art and are described, e.g., in U.S. Pat. Nos. 5,584,334, 5,577,837 (substantially laminar air flow), 5,526,231, 5,454,986 (substantially swirl free laminar flow), 5,451,330, 5,410,120

(substantially laminar downward flow), 5,381,701, and the like. The entire disclosure of each of these United States patents is hereby incorporated by reference into this specification.

Referring again to FIG. 2, it will be seen that the substantially laminar nature of the gas flow regime preferably exists a point 44, prior to bend 46. It will be apparent that it is important to have such substantially laminar flow regime prior to the introduction of the gas into gas contaminant separator tank 22, in which liquids and solids are removed from the gas stream. One may use any conventional gas contaminant separator for this purpose such as, e.g., the gas contaminant separators disclosed in U.S. Pat. Nos. 5,735,937, 5,554,209, 4,175,937, and the like. The entire disclosure of each of these United States patents is hereby incorporated by reference into this specification.

The gas from gas contaminant separator 22 passes via line 48 and passes through check valve 50 to line 52 and then into inlet manifold 24, which distributes the gas into lines 54 and 56 (shown in dotted outline in FIG. 1) and thence into guided rotor compressor 26.

The guided rotor compressor 26 depicted in FIG. 2 is substantially identical to the guided rotor compressor 10 disclosed in U.S. Pat. No. 5,431,551, the entire disclosure of which is hereby incorporated by reference into this patent application. This guided rotor compressor is preferably comprised of a housing comprising a curved inner surface with a profile equidistant form a trochoidal curve, an eccentric mounted on a shaft disposed within said housing, a first rotor mounted on said eccentric shaft which is comprised of a first side, a second side, and a third side, a first partial bore disposed at the intersection of said first side and said second side, a second partial bore disposed at the intersection of said second side and said third side, a third partial bore disposed at the intersection of said third side and said first side, a first solid roller disposed and rotatably mounted within said first partial bore, a second solid roller disposed and rotatably mounted within said second partial bore, and a third solid roller disposed and rotatably mounted within said third partial bore.

The rotor is comprised of a front face, a back face, said first side, said second side, and said third side. A first opening is formed between and communicates between said front face and said first side, a second opening is formed between and communicates between said back face and said first side, wherein each of said first opening and said second opening is substantially equidistant and symmetrical between said first partial bore and said second partial bore. A third opening is formed between and communicates between said front face and said second side. A fourth opening is formed between and communicates between said back face and said second side, wherein each of said third opening and said fourth opening is substantially equidistant and symmetrical between said second partial bore and said third partial bore. A fifth opening is formed between and communicates between said front face and said third side. A sixth opening is formed between and communicates between said back face and said third side, wherein each of said fifth opening and said sixth opening is substantially equidistant and symmetrical between said third partial bore and said first partial bore.

Each of said first partial bore, said second partial bore, and said third partial bore is comprised of a centerpoint which, as said rotary device rotates, moves along said trochoidal curve.

Each of said first opening, said second opening, said third opening, said fourth opening, said fifth opening, and said sixth opening has a substantially U-shaped cross-sectional shape defined by a first linear side, a second linear side, and an arcuate section joining said first linear side and said second linear side. The first linear side and the second linear side are disposed with respect to each other at an angle of less than ninety degrees; and said substantially U-shaped cross-sectional shape has a depth which is at least equal to its width.

The diameter of said first roller is equal to the diameter of said second solid roller, and the diameter of said second solid roller is equal to the diameter of said third solid roller.

The widths of each of said first opening, said second opening, said third opening, said fourth opening, said fifth opening, and said sixth opening are substantially the same, and the width of each of said openings is less than the diameter of said first solid roller.

Each of said first side, said second side, and said third side has substantially the same geometry and size and is a composite shape comprised of a first section and a second section, wherein said first section has a shape which is different from that of said second section.

The aforementioned compressor is a very preferred embodiment of the rotary positive displacement compressor which may be used as compressor 26; it is substantially smaller, more reliable, more durable, and quieter than prior art compressors. However, one may use other rotary positive displacement compressors such as, e.g., one or more of the compressors described in U.S. Pat. Nos. 5,605,124, 5,597,287, 5,537,974, 5,522,356, 5,489,199, 5,459,358, 5,410,998, 5,063,750, 4,531,899, and the like. The entire disclosure of each of these United States patents is hereby incorporated by reference into this specification.

In one preferred embodiment, the rotary positive displacement compressor used as compressor 26 is a Type 960080 Guided Rotor Compressor which is manufactured by the Phoenix Engine and Compressor Corporation of 210 Pennsylvania Avenue, East Aurora, N.Y.

Referring again to FIG. 2, the compressed gas from compressor 26 is passed via line 58 through check valve 60 to a second flow straightener 28 which reduces the turbulence of the gas in the same manner as flow straightener 20. It is preferred that flow straightener 28 have a smaller internal diameter than flow straightener 20 and have a higher pressure rating. Thus, by way of illustration, flow straightener 28 should preferably have a pressure rating of a least about 150 pounds per square inch, whereas flow straightener 20 should preferably have a pressure rating of no more than about 60 pounds per square inch.

The gas flowing through flow straightener 28 is passed via line 62 into air cooled radiator 30. Generally, the gas exiting from straightener 28 has a temperature in excess of 120 degrees Fahrenheit. When the gas enters radiator 30, its temperature will be reduced to a temperature no greater than about 120 degrees Fahrenheit. In general, the difference between the temperature of the gas in inlet line 62 and the temperature of the gas in exit line 64 is at least about 15 degrees Fahrenheit. As will be apparent to those skilled in the art, this temperature differential will vary with the size of radiator 30, the ambient temperature, the temperature of the inlet gas, the volume of inlet gas, and the volume of the cooling air.

Referring again to FIG. 2, in one embodiment, not shown, cooling air (not shown) flows across radiator 30.

The cooled gas from line 64 passes through check valve 66 through line 68 and thence into oil separator 32. One may use any conventional oil separator as separator 32. Thus, e.g., one may use one or more of the oil separators described in U.S. Pat. Nos. 5,618,335, 5,617,834, 5,617,731, 5,605,058, 5,603,224, 5,570,590, 5,570,583, 5,553,460, and the like. The entire disclosure of each of these United States patents is hereby incorporated by reference into this specification.

The gas from oil separator 32 is then passed via line 70 to check valve 72 and then to flow straightener 34. Flow straightener 34 preferably has characteristics which are similar to or identical to flow straightener 28, and it preferably has a similar pressure rating. It is preferred that the gas exiting from oil separator 32 have an oil content of less than about 2 percent of the gas flow volume.

The gas from flow straightener 34 is then preferably passed pass solenoid valve 74 and manual valve 76 to industrial application 16.

Referring again to FIG. 2, and in the preferred embodiment depicted therein, oil is preferably injected into the inlet ports 54 and 56 of compressor 26 by means of the inlet manifold 24. This oil injection system preferably comprises line 78, check valve 80, and solenoid valve 82. In one preferred embodiment, line 78 extends from the bottom of tank 32, where oil may have settled.

Referring again to FIG. 2, it will be seen that the compressor 26 is preferably driven by a means 84 for rotating shaft 86 which is coupled via coupling 88 to compressor shaft 90. In one embodiment, rotating means 84 is an electric motor. In another embodiment, rotating means 84 is a natural gas engine.

In the preferred embodiment depicted in FIG. 2, booster system 12 is preferably supported by a frame 92 which, preferably, is made from structural steel. It is preferred that frame 92 be both self-supporting and portable.

It is to be understood that the aforementioned description is illustrative only and that changes can be made in the apparatus, and in the sequence of combinations and process steps, as well as in other aspects of the invention discussed herein, without departing from the scope of the invention as defined in the following claims.

We claim:

1. An apparatus for maintaining gas pressure within a gas delivery system, wherein said apparatus is comprised of:

(a) a gas supply line for supplying gas, (b) a first means for reducing the turbulence of gas connected to said gas supply line, wherein said first means for reducing the turbulence of gas has a pressure rating of less than about 60 pounds per square inch, (c) a means for reducing contaminants present in said gas connected to said first means for reducing the turbulence of gas, (d) an inlet manifold connected to said means for reducing contaminants present in said gas, (e) a rotary positive displacement compressor connected to said inlet manifold, (f) a second means for reducing the turbulence of gas, wherein said second means for reducing the turbulence of gas has a pressure rating of at least about 150 pounds per square inch, and wherein said second means for reducing the turbulence of gas is connected to said rotary positive displacement compressor, (g) a radiator connected to said second means for reducing the turbulence of gas, and (h) a third means for reducing the turbulence of gas, wherein said third means for reducing the turbulence of gas has a pressure rating of at least about 150 pounds per square inch and is connected to said radiator.

2. The apparatus as recited in claim 1, wherein said rotary positive displacement compressor is a guided rotor compressor.

3. The apparatus as recited in claim 2, wherein said guided rotor compressor is comprised of a housing comprising a curved inner surface with a profile equidistant form a trochoidal curve, an eccentric mounted on a shaft disposed within said housing, a first rotor mounted on said eccentric shaft which is comprised of a first side, a second side, and a third side, a first partial bore disposed at the intersection of said first side and said second side, a second partial bore disposed at the intersection of said second side and said third side, a third partial bore disposed at the intersection of said third side and said first side, a first solid roller disposed and rotatably mounted within said first partial bore, a second solid roller disposed and rotatably mounted within said second partial bore, and a third solid roller disposed and rotatably mounted within said third partial bore.

4. The apparatus as recited in claim 3, wherein said first rotor comprised of a front face, a back face, said first side, said second side, and said third side.

5. The apparatus as recited in claim 4, wherein a first opening is formed between and communicates between said front face and said first side, a second opening is formed between and communicates between said back face and said first side, wherein each of said first opening and said second opening is substantially equidistant and symmetrical between said first partial bore and said second partial bore.

6. The apparatus as recited in claim 5, wherein a third opening is formed between and communicates between said front face and said second side, and a fourth opening is formed between and communicates between said back face and said second side, wherein each of said third opening and said fourth opening is substantially equidistant and symmetrical between said second partial bore and said third partial bore.

7. The apparatus as recited in claim 6, wherein a fifth opening is formed between and communicates between said front face and said third side, a sixth opening is formed between and communicates between said back face and said third side, and wherein each of said fifth opening and said sixth opening is substantially equidistant and symmetrical between said third partial bore and said first partial bore.

8. The apparatus as recited in claim 7, wherein each of said first partial bore, said second partial bore, and said third partial bore is comprised of a centerpoint which, as said rotary device rotates, moves along said trochoidal curve.

9. The apparatus as recited in claim 8, wherein each of said first opening, said second opening, said third opening, said fourth opening, said fifth opening, and said sixth opening has a substantially U-shaped cross-sectional shape defined by a first linear side, a second linear side, and an arcuate section joining said first linear side and said second linear side.

10. The apparatus as recited in claim 9, wherein said first linear side and said second linear side are disposed with respect to each other at an angle of less than ninety degrees; and said substantially U-shaped cross-sectional shape has a depth which is at least equal to its width.

11. The apparatus as recited in claim 10, wherein the diameter of said first roller is equal to the diameter of said second solid roller, and the diameter of said second solid roller is equal to the diameter of said third solid roller.

12. The apparatus as recited in claim 11, wherein the widths of each of said first opening, said second opening, said third opening, said fourth opening, said fifth opening, and said sixth opening are substantially the same, and the width of each of said openings is less than the diameter of said first solid roller.

13. The apparatus as recited in claim 12, wherein each of said first side, said second side, and said third side has substantially the same geometry and size and is a composite shape comprised of a first section and a second section, wherein said first section has a shape which is different from that of said second section.

14. The apparatus as recited in claim 1, wherein each of said means for reducing the turbulence of gas is comprised of means for producing substantially laminar flow in said gas.

15. The apparatus as recited in claim 1, wherein said radiator is an air cooled radiator.

16. The apparatus as recited in claim 1, wherein said apparatus is comprised of means for injecting oil into said compressor.

17. The apparatus as recited in claim 1, wherein said apparatus is comprised of means for rotating said rotor of said compressor.

18. The apparatus as recited in claim 17, wherein said means for rotating said rotor of said compressor is an electric motor.

19. The apparatus as recited in claim 17, wherein said means for rotating said rotor of said compressor is a natural gas engine.

* * * * *